US006745521B1

(12) United States Patent
Klemming

(10) Patent No.: US 6,745,521 B1
(45) Date of Patent: Jun. 8, 2004

(54) GAZEBO

(76) Inventor: Ulf JP Klemming, 215 Chao Hui Road, Zhongshan Hua Yuan, Qiu Yue Yuan 17 A, 310014 (CN)

( * ) Notice: Subject to any disclaimer, the term of this patent is extended or adjusted under 35 U.S.C. 154(b) by 0 days.

(21) Appl. No.: 10/318,568

(22) Filed: Dec. 13, 2002

(51) Int. Cl.[7] ..... E04H 3/00
(52) U.S. Cl. ..... 52/79.6; 52/82
(58) Field of Search ..... 52/82, 83, 79.4, 52/79.5, 79.6, 643, 645, 650.2; 135/141, 142

(56) References Cited

U.S. PATENT DOCUMENTS

| | | | | |
|---|---|---|---|---|
| 1,178,338 A | | 4/1916 | Niernsee | |
| 2,120,180 A | | 6/1938 | Hungrige | |
| 2,535,618 A | | 12/1950 | Williams | |
| 3,330,582 A | | 7/1967 | Morris | |
| 3,333,373 A | | 8/1967 | Taylor et al. | |
| 3,424,178 A | | 1/1969 | Yazaki | |
| 3,586,359 A | | 6/1971 | Cecelski | |
| 3,767,167 A | * | 10/1973 | Rasmussen | 256/26 |
| 4,018,016 A | | 4/1977 | Zale | |
| 4,586,300 A | | 5/1986 | Mullin | |
| 4,726,153 A | | 2/1988 | Adler et al. | |
| 5,291,716 A | | 3/1994 | Broberg et al. | |
| 5,598,668 A | | 2/1997 | Isom | |
| 5,617,681 A | | 4/1997 | Lyons | |
| 5,791,363 A | | 8/1998 | Moses | |
| 5,806,549 A | | 9/1998 | Love | |
| D411,309 S | | 6/1999 | St. Gelais et al. | |
| D458,689 S | | 6/2002 | Wang | |
| D482,130 S | * | 11/2003 | Wu | D25/56 |
| 6,676,113 B2 | * | 1/2004 | Christensen et al. | 256/25 |

* cited by examiner

*Primary Examiner*—Korie Chan
(74) *Attorney, Agent, or Firm*—Joseph E. Mueth

(57) ABSTRACT

A readily assembled and disassembled gazebo having a four sided upright portion made up of like sized pairs of panels at each of the four corners of said upright portion. Each pairs of panels is joined at right angles at one of their vertical edges. The pairs of panels are connected to adjacent pairs of panels at their upper extremities by tubular horizontal members spanning the space between the free vertical edges of the joined pairs of panels.

At each of the upper corner extremities of each of the joined pair of panel members and slidably received on projections extending above the panels, a corner member having a tubular projection projecting upwardly toward the center of the gazebo. Each of the tubular projection being slidably connected to a tubular roof supporting member.

All of the tubular roof supporting members are slidably connected to a raised central roof supporting member whereby the tubular roof supporting members and the central roof supporting member are adapted to support a sloping roof surface material covering the gazebo.

10 Claims, 7 Drawing Sheets

GAZEBO

BACKGROUND OF INVENTION

Various gazebos have been proposed which are fabricated in sections or pieces and are intended to be adapted for assembly and disassembly. For example, U.S. Design Pat. Nos. D458689, and D411309. Typically, a gazebo is sold in knocked down form with instructions to the buyer for assembly. The gazebos often are not left permanently in an assembled state. Instead, they may be, for example, assembled in the spring and disassembled in the fall, or put up for a special occasion and then taken down.

All of the gazebos known in the marketplace are assembled or held together with the aid of numerous fasteners (bolts, nuts and washers). Assembly and disassembly requires the use of tools which may tax the skill of many persons. In any event, the known gazebos take an hour or even several hours to assemble or disassemble, involving the placement and tightening of dozens of nuts, bolts and washers.

The present invention provides a gazebo which is for simpler to assemble and disassemble, and reduces the time required for each of these operations to a matter of fifteen minutes or even less, all without the need for tools.

SUMMARY OF INVENTION

Briefly, this invention comprises a readily assembled and disassembled gazebo having a four sided upright portion made up of like sized pairs of panels at each of the four corners of said upright portion, each said pairs of panels being joined at right angles at one of their vertical edges, each said pairs of panels being connected to adjacent pairs of panels at their upper extremities by tubular horizontal members spanning open space between the free vertical edges of said joined pairs of panels;

at each of the upper corner extremities of each of said joined pair of panel members and slidably received on projections extending above said panels, a corner member having a tubular projection projecting upwardly toward the center of the gazebo, each said tubular projection being slidably connected to a tubular roof supporting member, and said tubular roof supporting members being slidably connected to a raised central roof supporting member whereby said tubular roof supporting members and said central roof supporting member are adapted to support a sloping roof surface material covering said gazebo.

This invention further comprises a readily assembled and disassembled gazebo having a four sided upright portion made up of like sized pairs of panels at each of the four corners of said upright portion, each said pairs of panels being joined at right angles at one of their vertical edges, each said pairs of panels being connected to adjacent pairs of panels at their upper extremities by tubular horizontal members spanning open space between the free vertical edges of said joined pairs of panels;

at each of the upper corner extremities of each of said joined pair of panel members and slidably received on projections extending above said panels, a corner member having a tubular projection projecting upwardly toward the center of the gazebo, each said tubular projection being slidably connected to a tubular roof supporting member, and all of said tubular roof supporting members being slidably connected to a raised central roof supporting member whereby said tubular roof supporting members and said central roof supporting member are adapted to support a sloping roof surface material covering said gazebo.

Still further his invention further comprises a kit adapted to be readily assembled and disassembled to form a gazebo having a four sided upright portion, said kit including like sized pairs of panels for forming each of the four corners of said upright portion, each said pairs of panels being adapted to be joined together at right angles at one of their vertical edges, tubular members, each said pair of panels being adapted to connected to adjacent pairs of panels at its upper extremity by said tubular members to horizontally span open space between the free vertical edges of the joined pairs of panels;

a corner member adapted to be slidably received at each of the upper corner extremities of each of said joined pair of panel members, said corner member having a tubular projection projecting upwardly toward the center of the gazebo, tubular roof supporting members, each said tubular projection being adapted to be slidably connected to a said tubular roof supporting member, and a central roof supporting member, all of said roof supporting members being adapted to be slidably connected to said central roof supporting member whereby said tubular roof supporting members and said central roof supporting member are adapted to support a sloping roof surface material covering said gazebo.

DESCRIPTION OF PREFERRED EMBODIMENTS

Turning to the drawings in more detail, the gazebo comprises four pairs of upright panels, generally 10, 12, 14 and 16.

Referring more particularly to panel pair 10 which will serve as an example since the same is true of the other panel pairs, panel pair 10 has two panels 18 and 20, each having a generally open rigid rectangular frame in which is provided ornamental or decorative structure 22 which also affords cross-bracing for increase structural rigidity.

Figure 1:
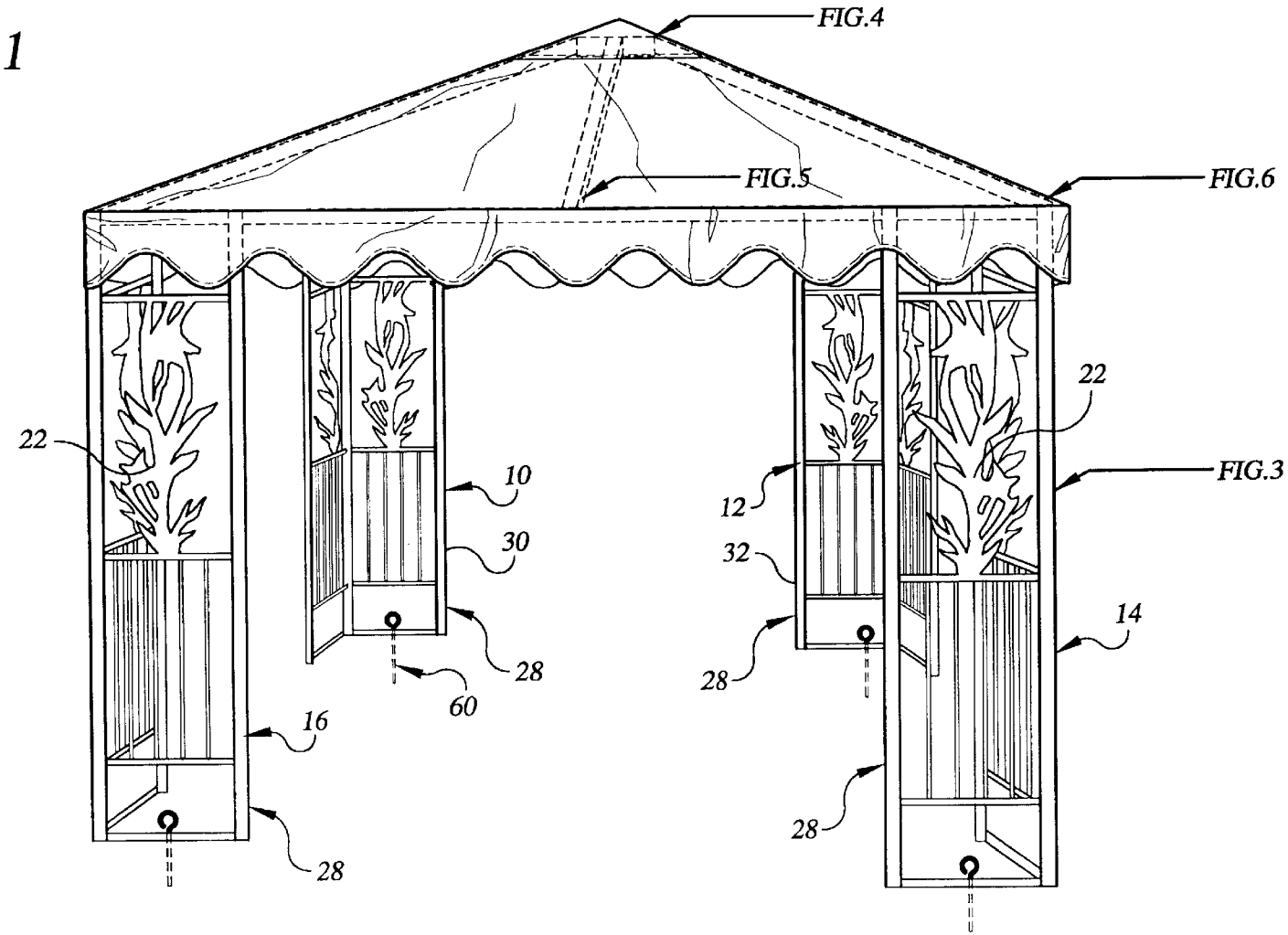
FIG. 1 is a perspective view of one embodiment of the gazebo of this invention, fully assembled.
Figure 2A:
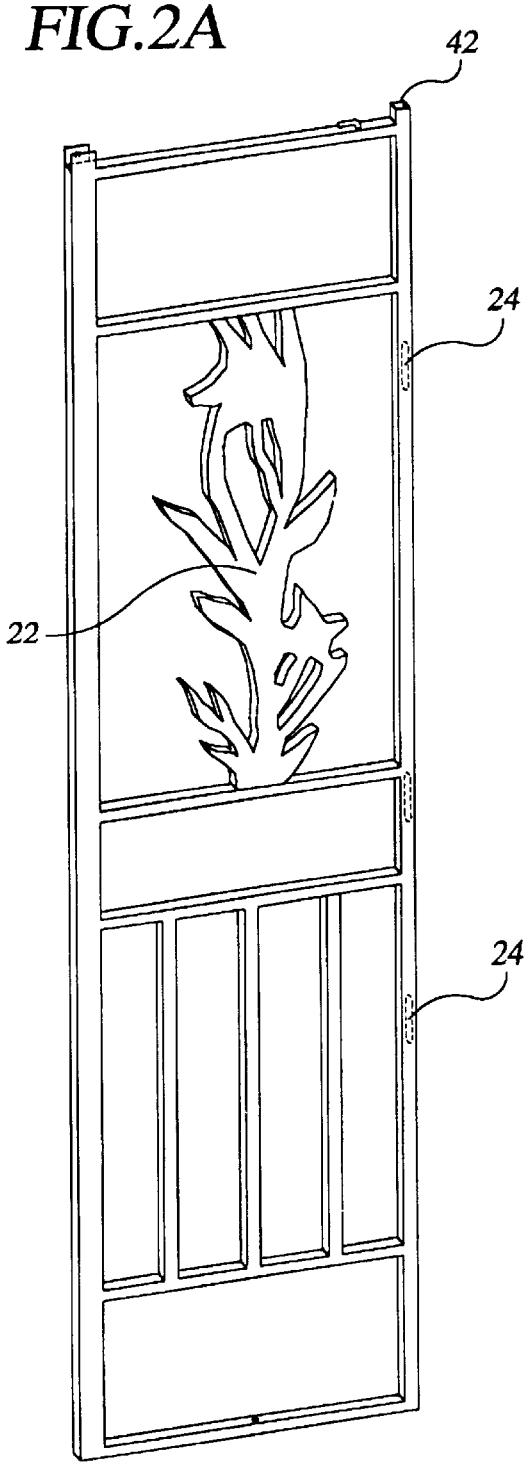
FIG. 2A is a side perspective view of one of the panels present at the corners of the gazebo of FIG. 1.
Figure 2B:
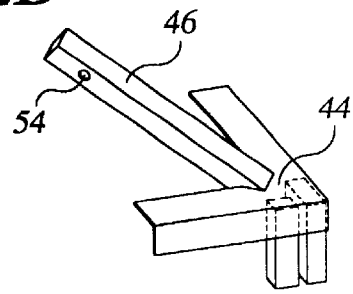
FIG. 2B is a perspective view of one of the four corner members.
Figure 2C:
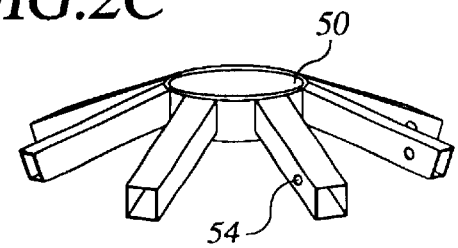
FIG. 2C is a perspective view of the raised center roof supporting member.
Figure 2D:
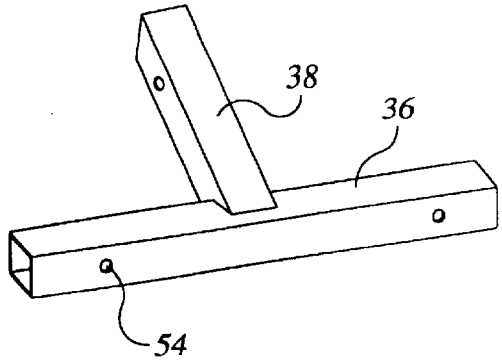
FIG. 2D is a perspective view of the complementary tubular member.
Figure 2E:
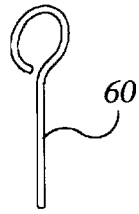
FIG. 2E is a pin used to hold down the assembled gazebo and prevent it from being blown over by winds.
Figure 3:
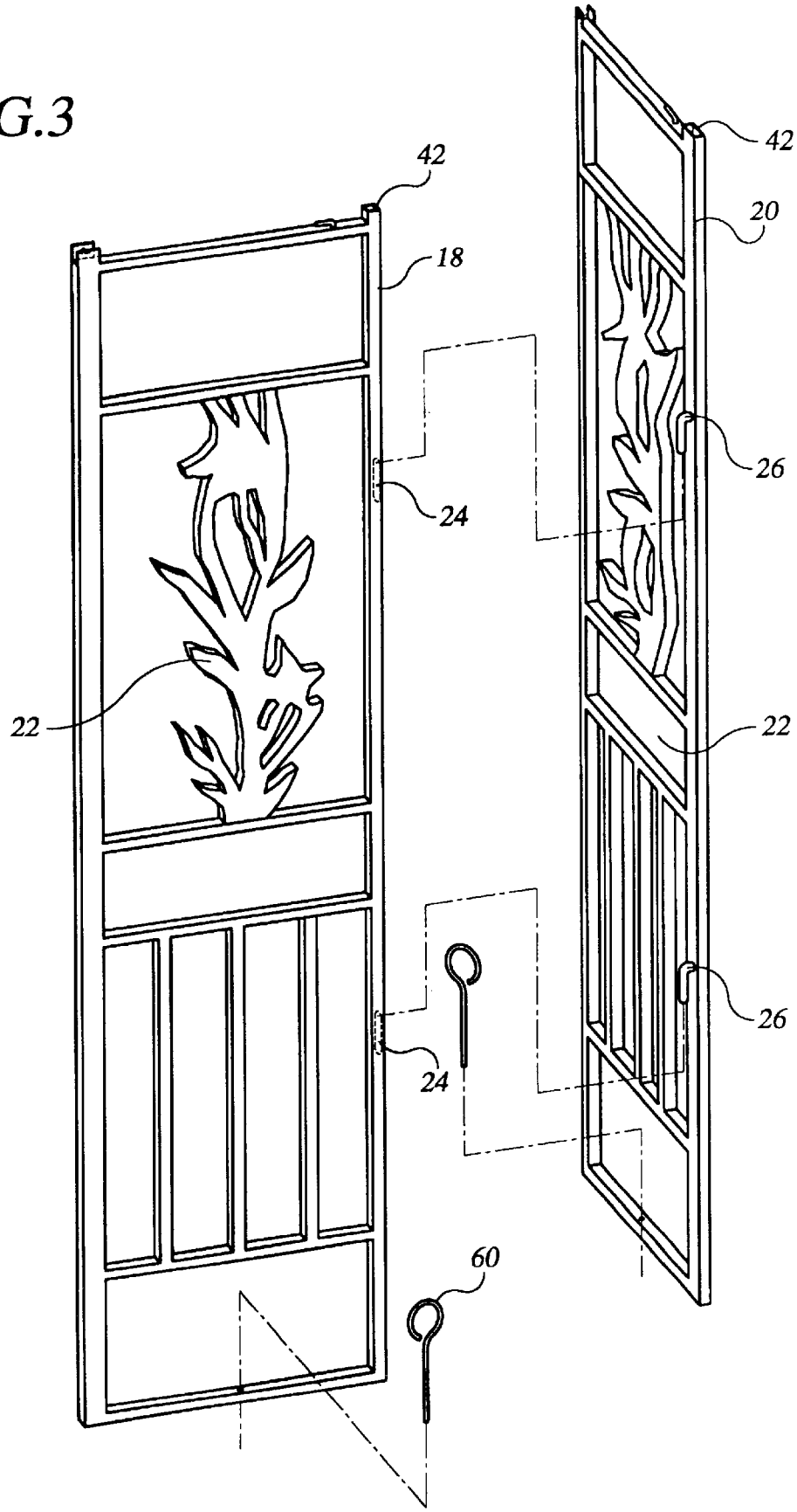
FIG. 3 is an exploded view showing how the like sized pairs of panels are joined to each other.
Figure 4:
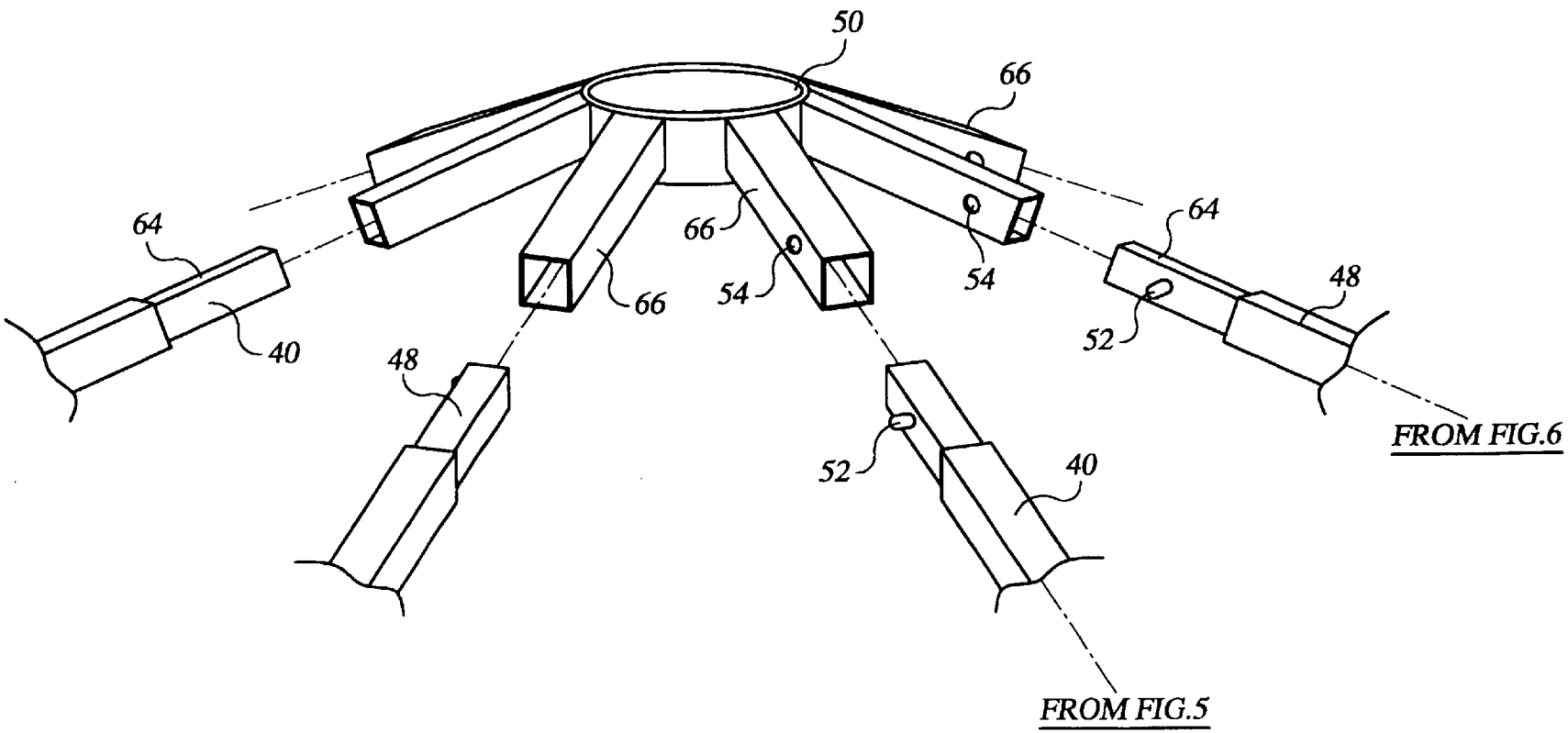
FIG. 4 shows how the raised central roof supporting member is connected to the eight roof supporting members.
Figure 5:
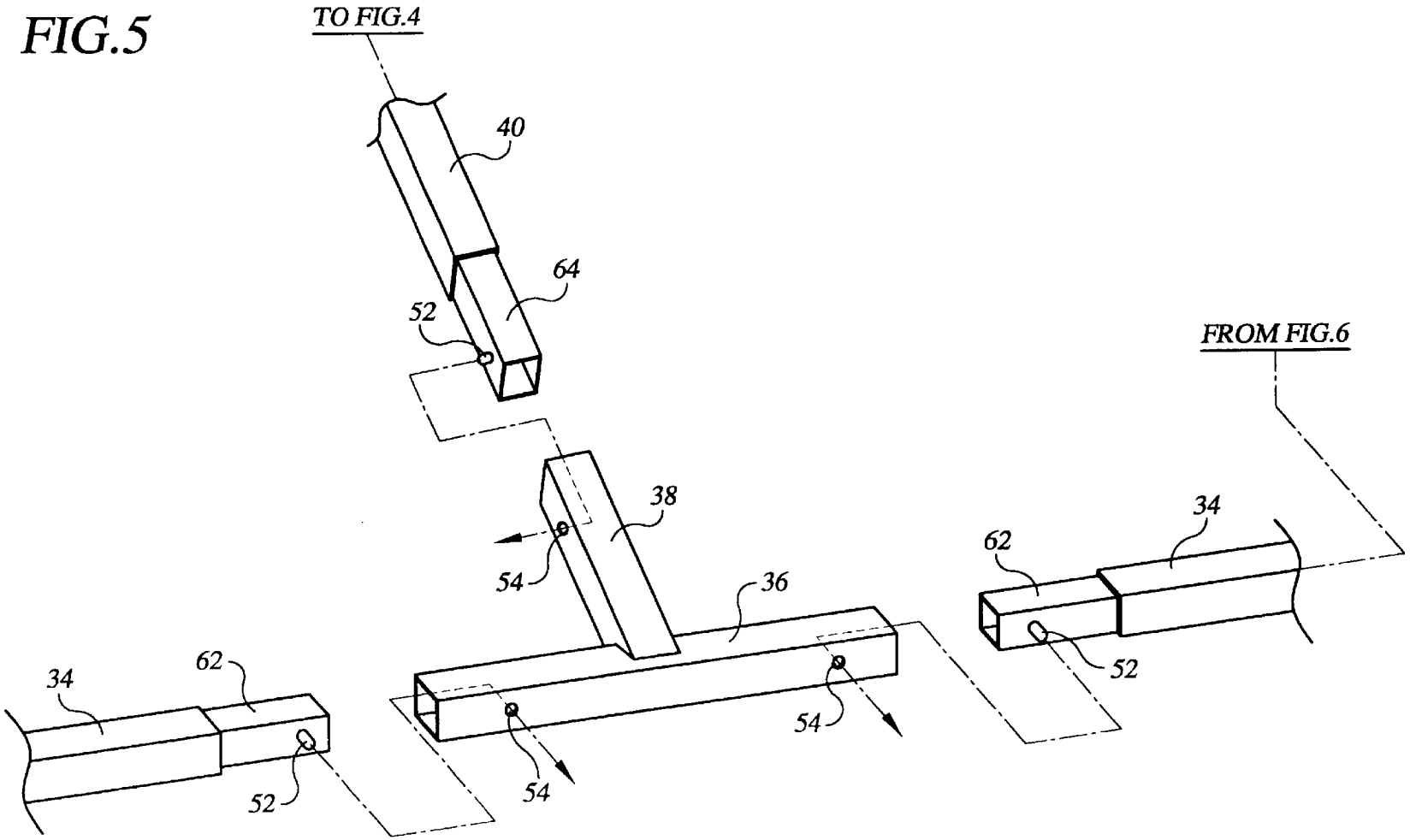
FIG. 5 shows how the tubular horizontal members and a tubular roof supporting member are joined to the complementary tubular member.
Figure 6:
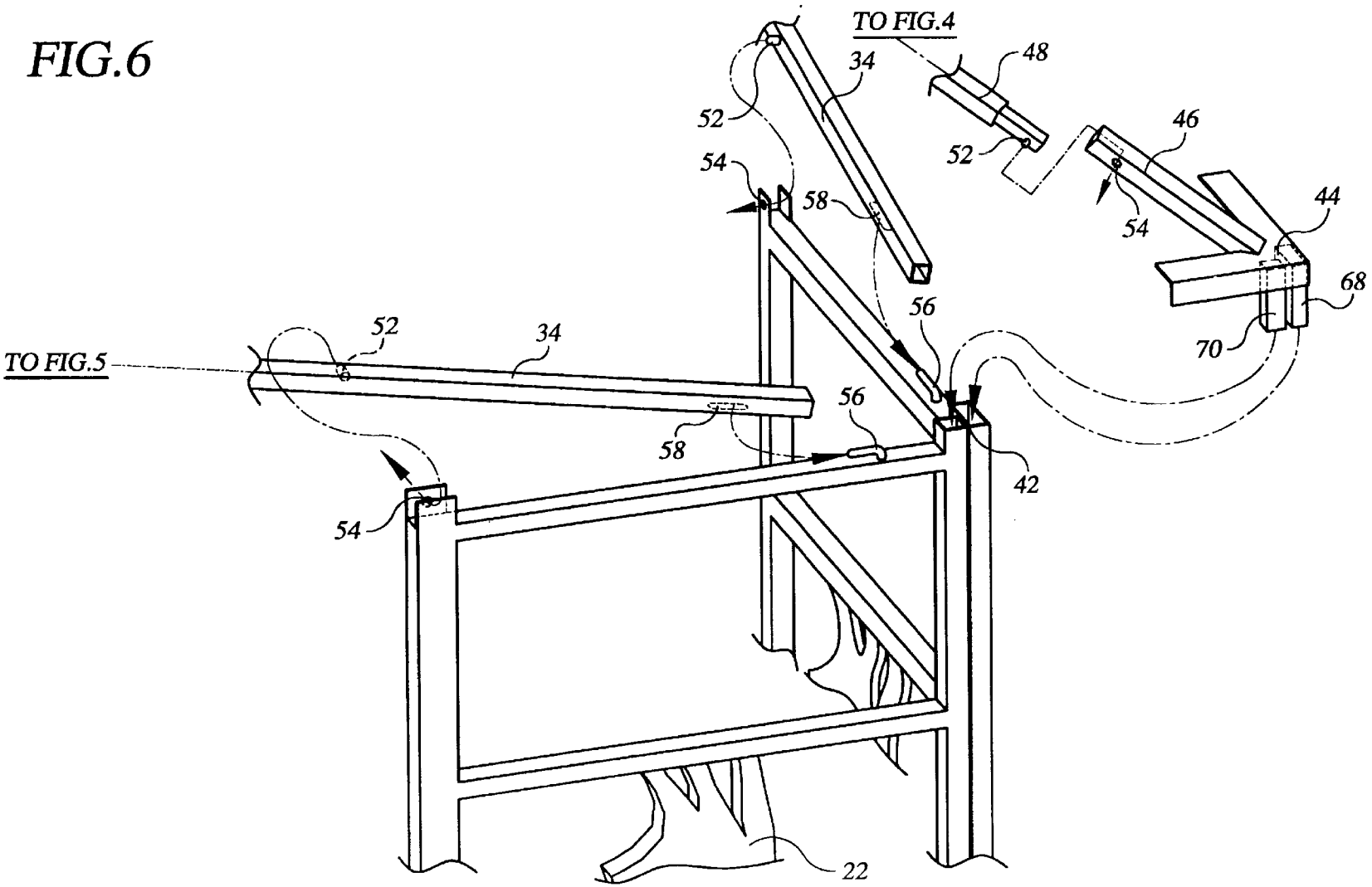
FIG. 6 is a top perspective view of one of the pairs of panels which have been connected and showing how the tubular horizontal members and the corner member are received on top of a pair of panels.

The panel 18 has two spaced apart openings 24 in a vertical edge. The panel 20 has two similarly spaced apart hooks 26. The hooks 24 are received in openings 24 so that panels 18 and 20 are held together as shown in FIG. 6.

The gazebo has at each of its four sides a large open space 28 between the free vertical edges 30 and 32 of each pair of panels. The adjacent pairs of panels are connected at their upper extremity by tubular horizontal members 34 spanning the space 28 between the free vertical edges, each said horizontal member including at its midpoint a complementary tubular member 36 forming a slip fit with the horizontal tubular member 34 connecting at each of its ends.

Each of the complementary tubular members 36 has a tubular projection 38 projecting upwardly at a right angle. The tubular projection 38 is slidably connected to tubular roof supporting member 40.

At each of the upper corner extremities of the joined pair of panel members are provided with integrally formed upwardly extending projections 42. Slidably received on each adjacent pair of projections 42 is a corner member 44 having a tubular member 46 projecting toward the center of the roof of the gazebo. Each of the tubular members 46 is slidably connected to a tubular roof supporting member 48.

All of the roof supporting members 40 and 48 (four of each) are slidably connected to the raised central roof supporting member or ring 50 whereby the roof supporting members 40 and 48 and the ring 50 form a rigid support structure which is higher in the central and is adapted to support a sloping roof surface material, such as canvas or plastic sheet, covering the top of the gazebo and forming a closed roof.

The various elements are secured, as shown, by spring loaded push pins 52 receivable in holes 54. By applying manual pressure, the pin 52 can be slid into the tubular member and then as that end of the tubular member is slipped into the adjoining tubular members, the pin 52 is released and is free to snap into hole 54.

The joinder of each of the horizontal tubular members 34 to the top of the panels 18 and 20 is by pin 52 received in hole 54 and by hook 56 received in opening 58. Hook 56 is permanently joined to the top edge of each panel.

The tubular members herein are generally hollow and light weight, and made of steel.

The hold down pin 60 can be pushed or driven into the ground to hold the assembly gazebo in place and keep it from blowing over in a high wind.

The gazebo of this invention is normally intended for sale in kit form with instructions for assembly.

Considering the drawings in further detail, the horizontal tubular members 34 each have at one end, lengths of reduced cross section 62 which is snugly and slidably received in complementary tubular members 36. Similarly, tubular roof supporting members 40 and 48 have ends 64 of reduced cross-section for slidable, snug insertion into members 66 of the central roof supporting member or ring 50 and opposed ends for slidable snug insertion into tubular projection 38 and tubular member 46.

The upwardly projecting projections 42 and the downwardly extending projections 68 and 70 on corner member 44 are sized such that projection 68 and 70 snugly slip over complementary sized and shaped projections 42. To further secure these members together, a cotter or clevis pin (not shown) may be inserted in lateral, aligned holes in these members at each of the four corners.

Figure 7:
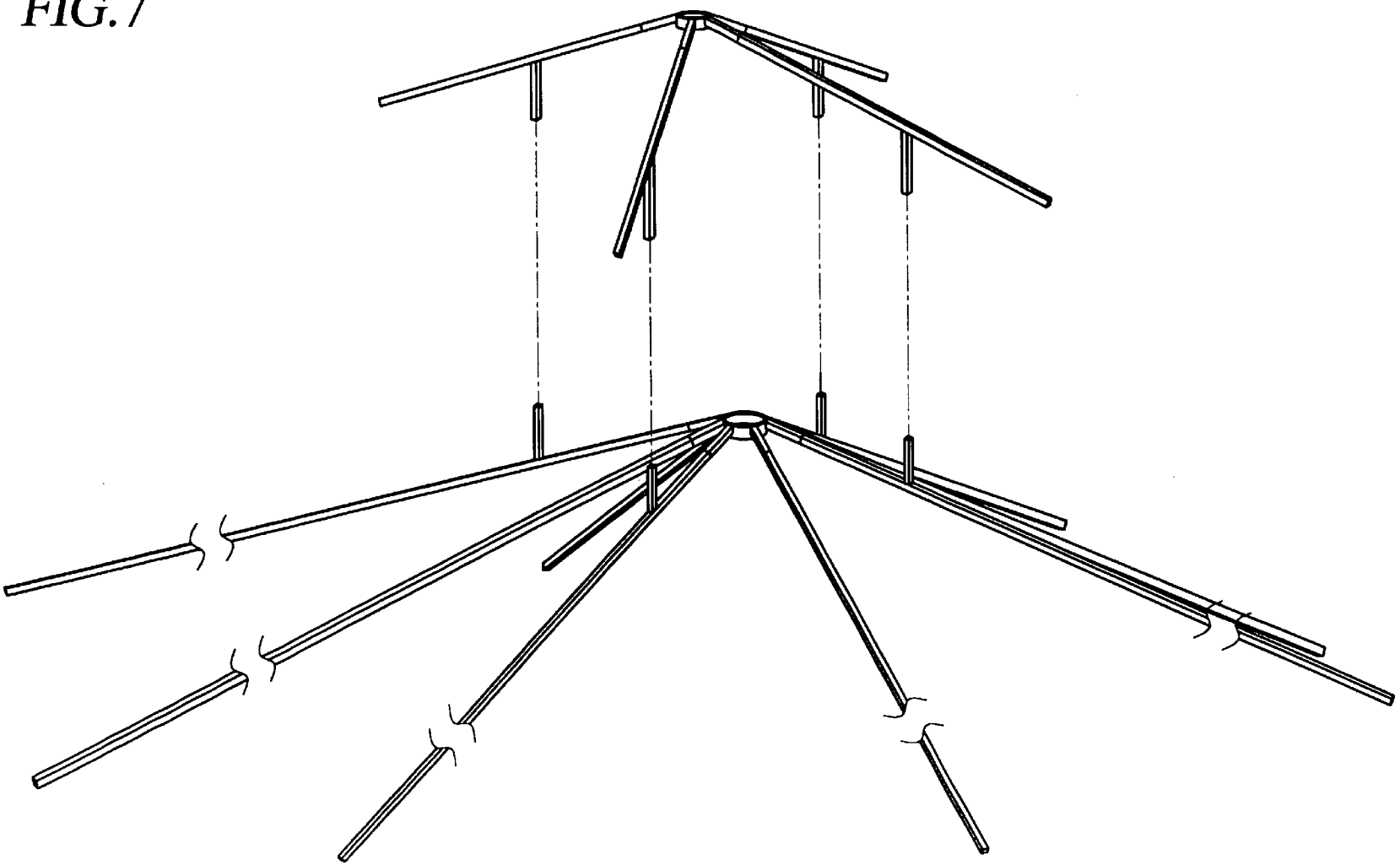
FIG. 7 is an optional embodiment of this invention.

FIG. 7 shows an alternate embodiment in which a smaller, second tier roof with supports may be carried above the main roof structure of the gazebo.

What is claimed is:

1. A readily assembled and disassembled gazebo having a four sided upright portion made up of like sized pairs of panels at each of the four corners of said upright portion, each said pairs of panels being joined at right angles at one of their vertical edges, each said pairs of panels being connected to adjacent pairs of panels at their upper extremities by tubular horizontal members spanning open space between the free vertical edges of said joined pairs of panels;

at each of the upper corner extremities of each of said joined pair of panel members and slidably received on projections extending above said panels, a corner member having a tubular projection projecting upwardly toward the center of the gazebo, each said tubular projection being slidably connected to a tubular roof supporting member, and said tubular roof supporting members being slidably connected to a raised central roof supporting member whereby said tubular roof supporting members and said central roof supporting member are adapted to support a sloping roof surface material covering said gazebo defining a tier.

2. The gazebo of claim 1 wherein each of said pairs of panels is joined at right angles at one of their vertical edges by a pair of spaced apart hooks received in a pair of similarly spaced apart openings.

3. The gazebo of claim 1 wherein each said horizontal tubular members is joined to one end of the upper edge of a panel by a hook received in an opening and at the other end of the upper edge of the panel by a spring loaded push pin received in a hole.

4. The gazebo of claim 1 wherein the roof supporting members have ends of reduced cross sections for slidable snug insertion into the central roof supporting member.

5. The gazebo of claim 1 wherein each panel comprises a generally open rigid rectangular frame provided with ornamental or structural elements which afford cross-bracing for increased structural rigidity.

6. The gazebo of claim 1 having at least four tubular roof supporting members.

7. The gazebo of claim 1 having a smaller second tier.

8. A readily assembled and disassembled gazebo having a four sided upright portion made up of like sized pairs of panels at each of the four corners of said upright portion, each said pairs of panels being joined at right angles at one of their vertical edges, each said pairs of panels being connected to adjacent pairs of panels at their upper extremities by tubular horizontal members spanning open space between the free vertical edges of said joined pairs of panels;

at each of the upper corner extremities of each of said joined pair of panel members and slidably received on projections extending above said panels, a corner member having a tubular projection projecting upwardly toward the center of the gazebo, each said tubular projection being slidably connected to a tubular roof supporting member, and all of said tubular roof supporting members being slidably connected to a raised central roof supporting member whereby said tubular roof supporting members and said central roof supporting member are adapted to support a sloping roof surface material covering said gazebo.

9. The gazebo of claim 8 having eight tubular roof supporting members.

10. A kit adapted to be readily assembled and disassembled to form a gazebo having a four sided upright portion, said kit including like sized pairs of panels for forming each of the four corners of said upright portion, each said pairs of panels being adapted to be joined at right angles at one of their vertical edges, tubular members, each said pair of panels being adapted to connected to adjacent pairs of panels at its upper extremity by said tubular members to horizontally span open space between the free vertical edges of said joined pairs of panels;

a corner member adapted to be slidably received at each of the upper corner extremities of each of said joined pair of panel members, said corner member having a tubular projection projecting upwardly toward the center of the gazebo, tubular roof supporting members, each said tubular projection being adapted to be slidably connected to a said tubular roof supporting member, and a central roof supporting member, all of said roof supporting members being adapted to be slidably connected to said central roof supporting member whereby said tubular roof supporting members and said central roof supporting member are adapted to support a sloping roof surface material covering said gazebo.

* * * * *